United States Patent [19]

Uyeda

[11] Patent Number: 4,924,196

[45] Date of Patent: May 8, 1990

[54] WAVEGUIDE MATRIX SWITCH

[75] Inventor: Harold A. Uyeda, Fullerton, Calif.

[73] Assignee: Hughes Aircraft Company, Los Angeles, Calif.

[21] Appl. No.: 284,034

[22] Filed: Dec. 14, 1988

[51] Int. Cl.[5] ..... H01P 1/10

[52] U.S. Cl. ..... 333/101; 333/109; 333/102; 333/113

[58] Field of Search ..... 333/101, 102, 109, 113, 333/115, 116, 121, 122

[56] References Cited

U.S. PATENT DOCUMENTS

| | | | |
|---|---|---|---|
| 2,973,512 | 2/1961 | Walsh | 333/113 X |
| 3,030,501 | 4/1962 | Rapuano | 333/121 X |
| 3,419,821 | 12/1968 | Jones | 333/101 |
| 3,480,885 | 11/1969 | Schrank | 333/101 |
| 4,153,994 | 5/1979 | Ren | 333/121 X |
| 4,254,385 | 3/1981 | Childs et al. | 333/116 X |
| 4,477,781 | 10/1984 | Reuss, Jr. | 330/286 |
| 4,583,061 | 4/1986 | O'Shea | 333/116 |

*Primary Examiner*—Paul Gensler

*Attorney, Agent, or Firm*—Wanda K. Denson-Low

[57] ABSTRACT

The invention is a low loss multiple pole multiple throw microwave switch having a transmission line for each of a plurality of outputs. A phase shifting device is provided in each transmission line operable between first and second states to shift the phase of a microwave signal transmitted therethrough. A matrix of signal dividers and cross-over networks cooperate with the phase shifting devices to produce additive and substractive vertical signal components such that all of the components at one output are additive and the signal components at all the other outputs have a vector sum of zero.

17 Claims, 2 Drawing Sheets

WAVEGUIDE MATRIX SWITCH

This invention was made with Government support under Contract No. NOOO14-84-C-2103 awarded by the Department of the Navy. The Government has certain rights in this invention.

BACKGROUND OF THE INVENTION

1. Field of the Invention

The present invention relates generally to the field of electronic switching apparatus and more particularly to electronic switching apparatus for waveguide switching for microwave applications.

2. Background Discussion

Common to most electrical and electronic apparatus are switching components. These switching components vary from simple mechanical "on-off" switches used to energize equipment to high speed solid state components, such as transistors, used in digital computers.

The most common electronic switches are those used in electrical or electronic circuits, for controlling the flow of electrons. Analogous switches are used in at least some advanced microwave circuits for controlling the flow of microwave energy. As an example, it may be required to switch the microwave output of a transmitter between two separate transmitting antennas. Conversely, it may be required to switch microwave signals received by a common antenna between two or more microwave signal processors. In more complex microwave equipment, it may be necessary to switch microwave signals from two or more sources between two or more pieces of equipment designed to utilize or process such microwave signals. These microwave switches are generally defined with respect to the number of "poles" and "throws" for which the switch is configured.

It should be appreciated that because of the different nature of electrons and microwaves electronic and microwave switches, although both are defined in the same manner, are usually substantially different in construction. In this regard, microwave switches especially those used in waveguide apparatus, are substantially more difficult to implement than are electronic switches, particularly when the microwave switches are required to have low switching losses.

Due to difficulties in providing low-loss microwave switches, especially in the millimeter wavelength range (that is, about 5 gigahertz) microwave waveguide switches typically require inter connections of phase shifters, quadrature hybrids, waveguide terminations, "magic tees" and cross over networks.

Single pole, double throw (SP2T) microwave switches employing the above-mentioned microwave components have been constructed. Single pole four throw (SP4T) microwave switches utilizing a parallel arrangement of two SP2T microwave switches with additional combining networks which have been implemented with such military hardware as the AN/SLQ-17, Threat Reactive Electronic Warfare System presently in use by the United States Navy.

However, as microwave systems increase in complexity and as performance requirements are made more stringent, an important need presently exists for low-loss microwave switches having greater switching capabilities as an example, a need presently exists for a low loss, waveguide SP8T switch, and the potential exists for a DP8T microwave switch, in the millimeter microwave range.

It can, be understood that many types of SPMT microwave switches can be constructed by "treeing" together, in a series-parallel relationship, an appropriate number of microwave switches of lesser switching capacity. In addition a SP8T microwave switch may alternately be constructed by treeing a SP2T switch with two SP4T switches or by treeing a 1-2-4 arrangement of SP2T microwave switches (as further described below).

However, such treeing arrangements of lesser capacity microwave switches in order to construct a greater capacity microwave switch gives rise to an amount of microwave power loss that is excessive for some or many critical microwave applications. These excessive switching losses may, as an example, result in the loss of weak received signals received by an antenna. Moreover such types of composite switches, may require the use of more microwave components and are consequently larger, more costly and possibly less reliable than more specially designed microwave switches. However, to the knowledge of the present inventor no SP8T or 2P8T microwave switches have been developed which do not use simple treeing arrangements of lesser capacity microwave switches and it is to such specifically designed SP8T and SP8T switches that the present invention is described.

SUMMARY OF THE INVENTION

In its broader aspects, the invention is a microwave switch for transmitting (or receiving) a microwave signal from an input to a selected one of a plurality of outputs. The switch includes a microwave transmission line for each output, each of the transmission lines being provided with a phase shifting device selectively operable between first and second operating states to shift the phase of a microwave signal transmitted therethrough. A signal dividing matrix is provided which includes a plurality of signal dividing means for dividing an input microwave signal between a pair of outputs without phase shift of the signals and a plurality of microwave signal coupling means for dividing an input microwave signal between a pair of outputs at a predetermined phase relationship. Typically, the coupling means provides two equal outputs having a quadrature phase relationship. The coupling means are connected between predetermined pairs of the transmission lines and separate the input microwave signals into a plurality of vectored components of predetermined phase relationship wherein all of the vectored components in the selected one of the plurality of outputs are additive and wherein all of the vectored components in all of the other of the plurality of outputs have a vector sum of zero. The additive and cancelling relationship of the vectored components is ultimately determined by selective operation of predetermined combinations of the phase shifting devices.

In a specific embodiment of the invention, the input microwave signal is initially divided by means of a plurality of folded magic tee's and the coupling means are provided in the form of quadrature hybrid microwave couplers. The signal dividing matrix comprises generally a parallel matrix as contrasted with a tree matrix thereby substantially reducing signal losses.

The microwave switch may further include a plurality of microwave crossover networks to selectively place the transmission lines in physically adjacent pairs as required to enable division of signals between adjacent ones of the transmission lines by the coupling means.

It is therefore an object of the invention to provide an improved multiple throw microwave switch.

It is another object of the invention to provide such a microwave switch which incorporates a parallel matrix of signal dividers and coupling means.

Yet another object of the invention is to provide a multiple throw microwave switch which enables switching an input signal to a selected one of a plurality of outputs by selective operation of the microwave phase shifters.

Still another object of the invention is to provide a microwave switch exhibiting substantially reduced signal losses.

Another object of the invention is to provide a microwave switch which can be adapted for multiple pole input multiple throw output configurations using a parallel matrix of magic tee's, hybrid couplers, magnetic phase shifters, and crossover networks to produce a microwave switch having substantially improved signal transmitting characteristics.

BRIEF DESCRIPTION OF THE DRAWINGS

These and other objects and purposes of the invention and the invention itself will be best understood in view of the following detailed description of the invention taken in conjunction with the appended drawings wherein.

DETAILED DESCRIPTION OF THE PREFERRED EMBODIMENT

Figure 1:
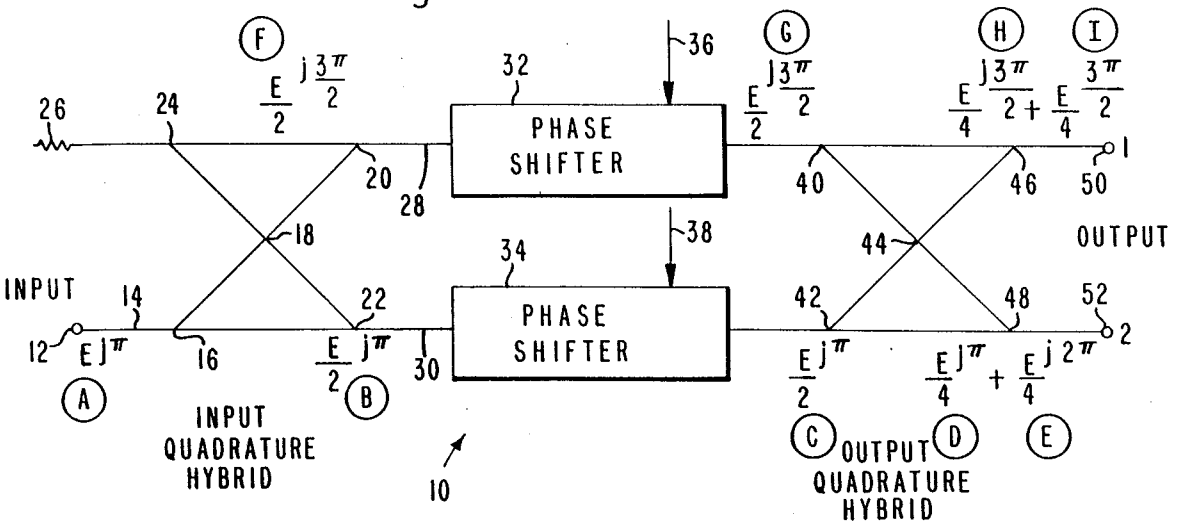
FIG. 1 is a schematic diagram of a single pole double throw switch useful in explaining the operation of the invention.
Figure 3:
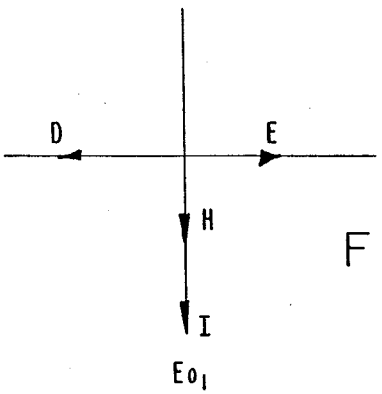
FIG. 3 is a simplified vector diagram useful in explaining the operation of the invention.

Referring first to FIG. 1, there is shown schematically a single pole double throw (SPDT) switch indicated generally at 10 which forms the basic building block of the present invention. The switch 10 comprises an input 12 which receives a microwave signal from a source of microwave signals (not shown). The microwave signal passes into a microwave transmission line 14 and then into one input port 16 of a quadrature microwave coupler 18. Coupler 18 totally comprises a pair of parallel microwave transmission lines interconnected by means such as apertures and in well known manner divides the signal input at port 16 between a pair of output ports 20, 22. The signal appearing at port 20 will lead the phase of the signal appearing at port 22 by 90°. Transmission line phase shifts will of course occur. However, these transmission line phase shifts will be essentially equal since the signals propagate through equal lengths of transmission lines in all branches of the switch. Accordingly they may be and are omitted from the discussion for clarity. The other input terminal 24 of the coupler 18 is terminated as indicated by resistance 26. It should be noted that a signal input to terminal 24 (which would yield a double pole double throw switch) would similarly be divided into signals appearing at ports 20 and 22 with the phase of the signal at port 22 leading the phase of the signal at port 20 by 90°. Microwave signals at ports 20, 22 are passed, again by microwave transmission lines 28, 30, to the inputs of a pair of phase shifters 32, 34. Phase shifters 32, 34 may be of any desired variety such as, for example, inductive phase shifters responsive to input signals via signal lines 36, 38, respectively to advance the phase of the signal input thereto by 180°. In the absence of the control signal, the signal passes through the phase shifter 32 or 34 without phase shift.

The outputs from the phase shifters 32, 34 are simultaneously applied to the input ports 40, 42 of another quadrature hybrid coupler 44 such that the signal input to port 40 is equally divided between output ports 46, 48, the signal at port 48 being advanced by 90° in phase, and the signal input to port 42 being equally divided between output ports 46, 48 with the signal at port 46 being advanced by 90°. The output ports 46, 48 are in turn connected to output ports 50, 52. It will now be recognized that the output signal at port 50 comprises a signal portion passed with zero degrees phase shift through quadrature hybrid coupler 18, the same signal either with or without a 180° phase shift (in response to the operating state of phase shifter 34), which signal is then advanced by 90° by quadrature hybrid coupler 44, and combined with a signal component from the output of port 20 of quadrature hybrid coupler 18, phase shifted 0° or 180° as determined by the state of phase shifter 32.

If both of phase shifters 32, 34 are in a state to produce a 0° phase shift, the relative magnitude and phase of the components of a signal E injected into input 12 will be as indicated in FIG. 1 as signals A through I. In this operative state, it will be seen that the signals appearing at output 50 are in phase and additive and all of the signals appearing at output 52 are of magnitude and phase to effect cancellation. If one of the phase shifters 32 or 34 is now operated to produce a 180° phase shift, signal components H and I will be of opposite phase and cancel while all the signal components at output 52 will now be in phase and additive. It will now be apparent that the switch 10 provides an effective single pole double throw switch comprised entirely of connected parallel components arranged in an appropriate matrix.

Figure 2:
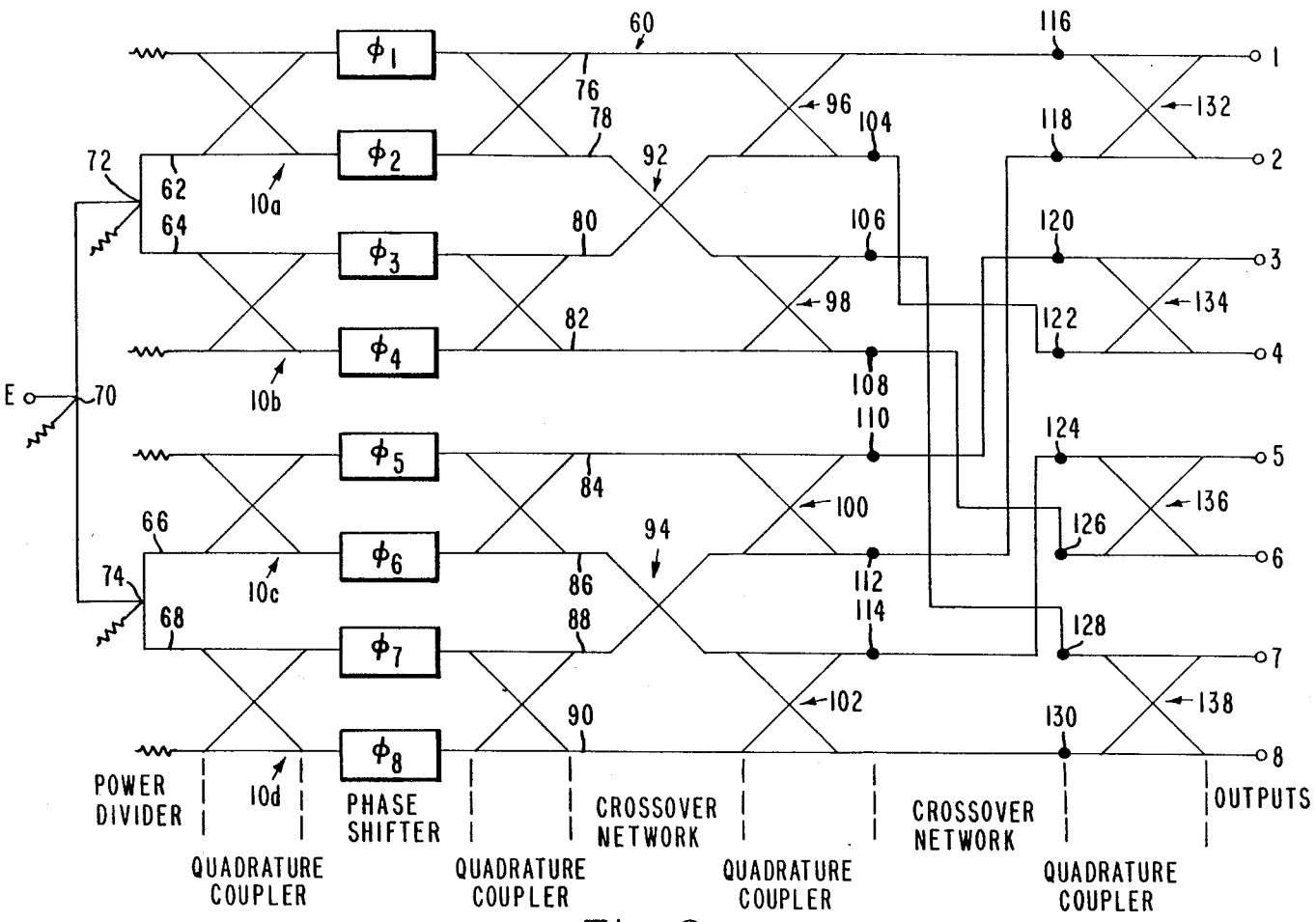
FIG. 2 is a schematic diagram of a single pole eight throw switch in accordance with the invention.

Referring now to FIG. 2, there is shown a single pole eight throw (SP8T) switch indicated generally at 60. Switch 60 includes four single pole double throw switch assemblies 10A, 10B, 10C and 10D having the same construction and function as switch 10 of FIG. 1. Four inputs 62, 64, 66 and 68 feed the single pole double throw assemblies 10A through 10D, the four inputs 62 through 68 being provided from a single input signal E as seen in FIGS. 1 and 2 and referred to a "$E_0$ in the following equations. The input signal E is applied to a tree matrix of three hybrid magic tee's 70, 72, and 74. The hybrid magic tee's 70, 72, 74 simply divide an input signal between a pair of output signals with both of the outputs from the tee's being in phase with the input signal. The outputs from the the tee's 72, 74 in turn feed the single pole double throw switch assemblies 10A through 10D wherein the signals are divided and shifted in phase as described above. The outputs from the switch assemblies 10A through 10D appear at terminals 76, 78, 80, 82, 84, 86, 88, and 90.

The signals appearing at output terminals 78, 80, 86, and 88 then pass through primary crossover networks 92, 94 where they are physically conducted into a differently paired array of parallel transmission lines and input to a group of quadrature couplers 96, 98, 100, and 102. The signals are again divided between the inputs and outputs of the couplers 96 through 102 with one of the output signals being advanced with respect thereto by 90°. The outputs appearing at output terminals 104, 106, 108 110, 112, and 114 are input to a secondary crossover network to again realign the outputs of the hybrid quadrature couplers 96 through 102. The realigned outputs are then applied to the input terminals 116, 118, 120, 122, 124, 126, 128, and 130 of a final group of hybrid quadrature couplers 132, 134, 136, and 138, wherein the signals are once again divided and shifted in phase in the manner described above.

Neglecting transmission line losses the complex voltage function appearing at the eight outputs E1, E2, E3, E4, E5, E6, E7, and E8 at terminals 1, 2, 3, 4, 5, 6, 7, and 8 seen in FIG. 2 will be:

$$E_1 = \frac{E_o}{8}\left\{ e^{j(\phi 1 - \frac{\pi}{2})} + e^{j(\phi 2 - \frac{\pi}{2})} + e^{j(\phi 3 - \frac{\pi}{2})} + e^{j(\phi 4 + \frac{3\pi}{2})} + e^{j(\phi 5 - \frac{3\pi}{2})} + e^{j(\phi 6 - \frac{3\pi}{2})} + e^{j(\phi 7 - \frac{\pi}{2})} + e^{j(\phi 8 + \frac{3\pi}{2})} \right\}$$

$$E_2 = \frac{E_o}{8}\{e^{j(\phi 1 + \pi)} + e^{j(\phi 2 - \pi)} + e^{j(\phi 3 + \pi)} + e^{j(\phi 4)} + e^{j(\phi 5 - \pi)} + e^{j(\phi 6 + \pi)} + e^{j(\phi 7)} + e^{j(\phi 8 + \pi)}\}$$

$$E_3 = \frac{E_o}{8}\left\{ e^{j(\phi 1 - \frac{3\pi}{2})} + e^{j(\phi 2 + \frac{3\pi}{2})} + e^{j(\phi 3 + \frac{\pi}{2})} + e^{j(\phi 4 + \frac{3\pi}{2})} + e^{j(\phi 5 + \frac{\pi}{2})} + e^{j(\phi 6 + \frac{\pi}{2})} + e^{j(\phi 7 + \frac{\pi}{2})} + e^{j(\phi 8 + \frac{3\pi}{2})} \right\}$$

$$E_4 = \frac{E_o}{8}\{e^{j(\phi 1 + \pi)} + e^{j(\phi 2 + \pi)} + e^{j(\phi 3)} + e^{j(\phi 4 + \pi)} + e^{j(\phi 5 + \pi)} + e^{j(\phi 6 + \pi)} + e^{j(\phi 7 + \pi)} + e^{j(\phi 8)}\}$$

$$E_5 = \frac{E_o}{8}\{e^{j(\phi 1)} + e^{j(\phi 2 + \pi)} + e^{j(\phi 3 + \pi)} + e^{j(\phi 4 + \pi)} + e^{j(\phi 5 - \pi)} + e^{j(\phi 6)} + e^{j(\phi 7 + \pi)} + e^{j(\phi 8 + \pi)}\}$$

$$E_6 = \frac{E_o}{8}\left\{ e^{j(\phi 1 + \frac{3\pi}{2})} + e^{j(\phi 2 + \frac{\pi}{2})} + e^{j(\phi 3 + \frac{\pi}{2})} + e^{j(\phi 4 + \frac{\pi}{2})} + e^{j(\phi 5 + \frac{3\pi}{2})} + e^{j(\phi 6 + \frac{\pi}{2})} + e^{j(\phi 7 + \frac{3\pi}{2})} + e^{j(\phi 8 + \frac{3\pi}{2})} \right\}$$

$$E_7 = \frac{E_o}{8}\{e^{j(\phi 1 + \pi)} + e^{j(\phi 2)} + e^{j(\phi 3 + \pi)} + e^{j(\phi 4 + \pi)} + e^{j(\phi 5)} + e^{j(\phi 6 + \pi)} + e^{j(\phi 7 + \pi)} + e^{j(\phi 8 + \pi)}\}$$

$$E_8 = \frac{E_o}{8}\left\{ e^{j(\phi 1 + \frac{3\pi}{2})} + e^{j(\phi 2 + \frac{\pi}{2})} + e^{j(\phi 3 + \frac{3\pi}{2})} + e^{j(\phi 4 + \frac{3\pi}{2})} + e^{j(\phi 5 + \frac{3\pi}{2})} + e^{j(\phi 6 + \frac{\pi}{2})} + e^{j(\phi 7 + \frac{\pi}{2})} + e^{j(\phi 8 + \frac{\pi}{2})} \right\}$$

WHERE

E=E=Input voltage $E_n$=Output voltage at nth terminal $\phi_n$=Phase state of nth phase shifter n=1, 2, 3 . . . 8

Again the transmission line phase shifts have been omitted for clarity since they will be common phase terms appearing with each of the output voltages.

It will now be apparent that if the individual phase shifters 1 through 8 are energized in predetermined combinations, all of the signal complements comprising the output voltage function for one of the outputs E1 through E8 will comprise signal components in phase and accordingly additive while the signal complements of the other seven complex voltage functions representing the outputs at the other seven outputs will comprise equal numbers of oppositely phased signal complements which cancel and produce a zero output signal. For example, if phase shifters 4, 5, 6, and 8 are energized to produce a 180° phase shift in their input signals, it will be seen that all of the signal components appearing at output E1 will be in phase while all of the signal components in outputs E2 through E8 will comprise equal numbers of oppositely phased components producing output signals of 0. The phase shifter energization combinations required to produce outputs at each of the eight outputs are shown in tabular form below.

| Phase Shifter State | $\phi_1$ | $\phi_2$ | $\phi_3$ | $\phi_4$ | $\phi_5$ | $\phi_6$ | $\phi_7$ | $\phi_8$ | Output On |
|---|---|---|---|---|---|---|---|---|---|
| | 0 | 0 | 0 | 180 | 180 | 180 | 0 | 180 | 1 |
| | 0 | 0 | 0 | 180 | 0 | 0 | 180 | 0 | 2 |
| | 0 | 0 | 180 | 0 | 180 | 180 | 180 | 0 | 3 |
| | 0 | 0 | 180 | 0 | 0 | 0 | 0 | 180 | 4 |
| | 180 | 0 | 0 | 0 | 0 | 180 | 0 | 0 | 5 |
| | 0 | 180 | 180 | 180 | 0 | 180 | 0 | 0 | 6 |
| | 0 | 180 | 0 | 0 | 180 | 0 | 0 | 0 | 7 |
| | 0 | 180 | 0 | 0 | 0 | 180 | 180 | 180 | 8 |

Referring again to FIG. 2, will be seen that the input 70, can also comprise a parallel input waveguide enabling the input of two input signals. In this case, the switch 60 of FIG. 2 can also function as a two pole eight throw switch. By further parallel combination of the other terminated ports of the input power dividing section, this switch can be extended to an eight pole eight throw switch. From the above description it will further be apparent that even larger and more complex multiple pole multiple throw switches can be fabricated by combining parallel arranged double pole double throw switches connected to a power dividing input and an appropriately arranged output matrix of hybrid couplers and crossover networks. Since the components are substantially a parallel arrangement of components which produce substantially low loss signal transmission and substantially ideal phase shift, the multiple pole multiple throw switch of the present invention provides a highly efficient method of producing output signals at a desired one of a plurality of outputs and are receiving output signals from one of a plurality of antennas or other microwave devices.

While the present invention has been described with reference to specific components and the preferred embodiment, it will be apparent to those skilled in the art that various modifications of the invention can be made by those skilled in the art without departing from the spirit and scope of the invention.

What is claimed is:

1. A microwave switch comprising:

at least one switch input port and first, second, third, fourth, fifth, sixth, seventh, and eighth output ports;

a plurality of signal divider means each having divider input ports connected to said switch input port and each having a pair of outputs for equally dividing an input microwave signal into four in-phase first signal components;

a first coupling means connected to receive each said first signal component for equally dividing each said first signal component into quadrature phased second signal components;

a phase shifter means connected to receive said second signal components and selectively operable between first and second states to output individual ones of said second signal components with one of a zero and a 180 degree phase shift, respectively;

second coupling means connected to receive the second signal components from predetermined pairs of said phase shifter means for equally dividing each said second signal component into quadrature phased third signal components;

third coupling means connected to receive predetermined pairs of said third signal components for equally dividing said third signal components into quadrature phased fourth signal components for equally dividing said fourth signal components into quadrature phased fourth signal components;

fourth coupling means connected to receive predetermined pairs of said fourth signal components for equally dividing said fourth signal components into quadrature phased fifth signal components; and said output ports being connected to receive said fifth signal components, said fifth signal components comprising a plurality of phased signal components of phase determined by the combination of predetermined pairings of inputs to said first through said fourth coupling means and the selected operative states of said phase shifting means, seven of the outputs of said output ports having a vector sum of zero and one of the outputs of said output ports having a vector sum of one.

2. The microwave switch of claim 1 wherein there is a first, second, third, fourth, fifth, sixth, seventh and eighth said phase shifting means, said first, fourth, fifth and eighth phase shifting means being connected to receive quadrature phased ones of said second signal components.

3. The microwave switch of claim 2 wherein there is a first, second, third, and fourth said second coupling means, the first of said second coupling means being connected to receive the outputs of the first and second of said phase shifter means, the second of said second coupling means being connected to receive the outputs of the third and fourth said phase shifter means, the third of said second coupling means being connected to receive the outputs of said fifth and sixth phase shifter means and the fourth of said second coupling means being connected to receive the outputs of the seventh and eighth said phase shifter means.

4. The microwave switch of claim 3 further including:

first, second, third and fourth third coupling means;

a first intermediate crossover network coupling one output of the first and second said second coupling means to an input of the second and first said third coupling means, respectively, and a second intermediate crossover network coupling one output of the third and fourth said second coupling means to inputs of the fourth and third said third coupling means respectively, the other output of the first, second, third, and fourth said second coupling means being connected to the other input of said first, second, third, and fourth said third coupling means, respectively.

5. The microwave switch of claim 4 further including a tertiary crossover network connecting the outputs of the first of said third coupling means to said first and fourth output ports through said first and second said fourth coupling means, respectively, the outputs of the second of said third coupling means to said seventh and sixth output ports through said fourth and third said fourth coupling means, respectively, the outputs of the third of said third coupling means to said third and second output ports through said second and first said fourth coupling means, respectively, and the outputs of the fourth of said third coupling means to said fifth and eighth output ports through said third and fourth said fourth coupling means, respectively.

6. The microwave switch of claim 5 wherein the first, second, third, and fourth said fourth coupling means are connected between said first and second, said third and fourth, said fifth and sixth, and said seventh and eighth said output ports, respectively.

7. The microwave switch of claim 6 wherein said signal divider means are magic tees.

8. The microwave switch of claim 6 wherein said coupling means are quadrature hybrid microwave couplers.

9. The microwave switch of claim 6 wherein said phase shifter means are wide band ferrite phase shifters.

10. A microwave switch comprising:

at least one switch input port and first, second, third, fourth, fifth, sixth, seventh, and eighth output ports;

a plurality of signal divider means each having divider input ports connected to said switch input port and each having a pair of outputs for equally dividing an input microwave signal into four in-phase first signal components;

a first coupling means connected to receive each said first signal component for equally dividing each said first signal components into quadrature phased second signal components;

first, second, third, fourth, fifth, sixth, seventh and eighth phase shifting means respectively connected to receive predetermined ones of the quadrature phased second signal components and to output individual ones of said second signal components with one of a zero and a 180 degree phase shift;

first, second, third, and fourth second coupling means being connected to receive the outputs of said first of said second coupling means being connected to receive the outputs of said first and second of said phase shifter means, the second of said second coupling means being connected to receive the outputs of said third and fourth said phase shifter means, the third of said second coupling means being connected to receive the outputs of said fifth and sixth phase shifter means and the fourth of said second coupling means being connected to receive the outputs of the seventh and eighth said phase shifter means for equally dividing each of said output signal components into quadrature phased third signal components;

third coupling means connected to receive predetermined pairs of said third signal components for equally dividing said third signal components into quadrature phased fourth signal components;

fourth coupling means connected to receive predetermined pairs of said fourth signal components; and said output ports being connected to receive said fifth signal components, said fifth signal components comprising a plurality of phased signal components of phase determined by the combination of predetermined pairings of inputs to said first through said fourth coupling means and the operative states of said phase shifting means, seven of the outputs of said output ports having a vector sum of zero and one of the outputs of said output ports having a vector sum of one.

11. The microwave switch of claim 10 wherein said signal divider means are magic tees.

12. The microwave switch of claim 10 wherein said coupling means are quadrature hybrid microwave couplers.

13. The microwave switch of claim 10 wherein said phase shifter are wide band ferrite phase shifters.

14. A microwave switch comprising:

at least one switch input port and first, second, third, fourth, fifth, sixth, seventh and eighth output ports;

a plurality of signal divider means each having divider input ports connected to said switch input port and each having a pair of outputs for equally dividing an input microwave signal into four in-phase first signal components;

a first coupling means connected to receive each said first signal component for equally dividing each said first signal component into quadrature phased second signal components;

a phase shifter means connected to receive each said second signal component and selectively operable between first and second states to output individual ones of said second signal components with a selected one of a zero and a 180 degree phase shift, respectively;

second coupling means connected to receive said second signal components output from pairs of said phase shifter means for equally dividing each said second signal component into quadrature phased third signal components;

first, second, third, and fourth third coupling means connected to receive predetermined pairs of said third signal components for equally dividing each of said third signal components into quadrature phased fourth signal components;

fourth coupling means connected to receive predetermined pairs of said fourth signal components into quadrature phased fifth signal components;

a tertiary crossover network connecting the outputs of the first of said third coupling means to said first and fourth output port through said first and second said fourth coupling means, respectively, the outputs of the second of said third coupling means to said seventh and sixth output ports through said fourth and third said fourth coupling means, respectively, the outputs of the third of said third coupling means to said third and second output ports through said second and first said fourth coupling means, respectively, and the outputs of the fourth of said third coupling means to said fifth and eighth output ports through said third and fourth said fourth coupling means, respectively; and said output ports being connected to receive said fifth signal components, said fifth signal components comprising a plurality of phased signal components of phase determined by the combination of predetermined pairings of inputs to said first through said fourth coupling means and the operative states of said phase shifting means, seven of the outputs of said output ports having a vector sum of zero and one of the outputs of said outputs of said output ports having a vector sum of one.

15. The microwave switch of claim 14 wherein said signal divider means are magic tees.

16. The microwave switch of claim 14 wherein said coupling means are quadrature hybrid microwave couplers.

17. The microwave switch of claim 14 wherein said phase shifter means are wide band ferrite phase shifters.

* * * * *